US005950434A

United States Patent [19]

Hums et al.

[11] Patent Number: 5,950,434

[45] Date of Patent: Sep. 14, 1999

[54] BURNER, PARTICULARLY FOR A GAS TURBINE, WITH CATALYTICALLY INDUCED COMBUSTION

[75] Inventors: Erich Hums, Hessdorf; Nicolas Vortmeyer, Essen, both of Germany

[73] Assignee: Siemens Aktiengesellschaft, Munich, Germany

[21] Appl. No.: 08/989,966

[22] Filed: Dec. 12, 1997

Related U.S. Application Data

[63] Continuation of application No. PCT/DE96/01019, Jun. 11, 1996.

[30] Foreign Application Priority Data

Jun. 12, 1995 [DE] Germany ..... 195 21 309

[51] Int. Cl.[6] ..... F23R 3/40

[52] U.S. Cl. ..... 60/723; 60/39.822

[58] Field of Search ..... 60/39.12, 39.822, 60/723

[56] References Cited

U.S. PATENT DOCUMENTS 3,928,961 12/1975 Pfefferle ..... 60/723
4,825,658 5/1989 Beebe .
5,048,284 9/1991 Lywood et al. .
5,235,804 8/1993 Colket et al. ..... 60/723

FOREIGN PATENT DOCUMENTS 0 304 707 A1 3/1989 European Pat. Off. .
0 491 481 A1 6/1992 European Pat. Off. .
0 677 707 A1 10/1995 European Pat. Off. .
92/20962 11/1992 WIPO .

OTHER PUBLICATIONS

Patent Abstracts of Japan No. 61276627 (Fukuo), dated Dec. 6, 1985.
Patent Abstracts of Japan No. 59063407 (Riyouji), dated Apr. 11, 1984.

*Primary Examiner*—Louis J. Casaregola
*Attorney, Agent, or Firm*—Herbert L. Lerner; Laurence A. Greenberg

[57] ABSTRACT

A gas turbine and a burner to be used for all gas turbines for the catalytically induced combustion of a fuel, include a flow duct and a main burner having a fuel outlet. A catalytic supporting burner has a fuel outlet in the flow duct upstream of the fuel outlet of the main burner, as seen in the flow direction of the fuel, for stabilizing the main burner along with catalytic combustion of a pilot fuel stream. A marked reduction in nitrogen oxide emission is achieved by replacing a diffusion pilot flame with a catalytic supporting burner.

6 Claims, 2 Drawing Sheets

BURNER, PARTICULARLY FOR A GAS TURBINE, WITH CATALYTICALLY INDUCED COMBUSTION

CROSS-REFERENCE TO RELATED APPLICATION

This application is a continuation of International Application Ser. No. PCT/DE96/01019, filed Jun. 11, 1996, which designated the United States.

BACKGROUND OF THE INVENTION

FIELD OF THE INVENTION

The invention relates to a burner, particularly for a gas turbine, including a catalytic supporting burner for stabilizing a main burner. The invention also relates to a gas turbine having the burner.

The fuel provided in this case is, for example, natural gas, coal gas or another hydrocarbon-containing and/or hydrogen-containing gas mixture. However, such a mixture or else a fossil fuel in liquid form is also suitable.

The combustion of the fuel mentioned above also gives rise to nitrogen oxides $NO_x$ which are particularly undesirable combustion products. Such nitrogen oxides, along with sulfur dioxide, are the main cause of the environmental problem of acid rain. Consequently, as well as in view of strict statutory norms on limit values for the emission of $NO_x$, the aim is to keep the $NO_x$ emission of, for example, a burner in a gas turbine particularly low and, at the same time, avoid appreciably influencing the power of the burner or of the gas turbine.

Thus, for example, lowering the flame temperature in the burner has the effect of reducing the nitrogen oxides. In that case, steam is added to the fuel or to a compressed and preheated fresh air, or water is injected into the combustion space. Such measures, which per se decrease the emission of nitrogen oxides from the burner, are referred to as primary measures for the reduction of nitrogen oxides.

Accordingly, all of those measures in which nitrogen oxides contained in the exhaust gas of a combustion process are decreased through the use of subsequent measures, are referred to as secondary measures.

In that respect, the method of selective catalytic reduction (SCR) has gained acceptance throughout the world. In that method, the nitrogen oxides, together with a reducing agent, usually ammonia, are brought into contact with a catalyst and at the same time form nitrogen and water. The use of that technology therefore necessarily entails the consumption of reducing agents. The catalytic converters which are disposed in the exhaust-gas duct for reducing the nitrogen oxides naturally cause a pressure drop in the exhaust-gas duct. However, if the burner is used in a gas turbine, such a pressure drop leads to a considerable power drop in the turbine. Even a power drop amounting to a few points per thousand, in the case of a gas turbine power of 150 MW, for example, and a current-purchasing price of about $0.016/kWh (and about 0.15 DM/kWh in Germany, for example) for current, has a serious effect on the result which can be achieved with such an apparatus.

Recent considerations with regard to the construction of the burner tend towards replacing the diffusion burner or swirl-stabilized premixing burner that is conventionally used in a gas turbine with a catalytic combustion chamber. Lower emissions of nitrogen oxides are achieved with a catalytic combustion chamber than is possible with the above-mentioned burner types. In that way, the known disadvantages of the SCR method (large catalyst volumes, consumption of reducing agent, high pressure loss) can be overcome.

Conventionally, there is provision for using a pilot flame for the stabilization of burners (diffusion burners, swirl-stabilized premixing burners, catalytic burners). The pilot flame is used in order to set a specific starting point for the combustion of the actual main stream of fuel gas. A burner for generating such a pilot flame is conventionally a diffusion burner which constitutes an appreciable source of nitrogen oxides. In view of the environmental problems caused by nitrogen oxides and due to strict statutory conditions for the emission of nitrogen oxides, the aim is therefore to avoid any nitrogen oxide source even as small as that or at least to decrease its emission of nitrogen oxides.

SUMMARY OF THE INVENTION

It is accordingly an object of the invention to provide a burner, particularly for a gas turbine, with catalytically induced combustion, and a gas turbine having the burner, which overcome the hereinafore-mentioned disadvantages of the heretofore-known devices of this general type and in which a device for generating a pilot flame works with a particularly low emission of nitrogen oxides.

With the foregoing and other objects in view there is provided, in accordance with the invention, a burner for combusting a fuel, comprising a flow conduit conducting a fuel in a given flow direction and having a given cross section; a main burner disposed coronally relative to the given cross section and having a fuel outlet; and a catalytic support burner disposed centrally relative to the given cross section and having a fuel outlet in the flow conduit upstream of the fuel outlet of the main burner as seen in the given flow direction, for stabilizing the main burner with catalytic combustion of a pilot fuel stream.

In this case, the supporting burner utilizes catalytic combustion of the pilot fuel stream for the purpose of stabilizing or supporting the main burner.

In this way, the pilot flame which is necessary for stabilizing the main burner or main burners is generated as a result of catalytic combustion which is particularly low in nitrogen oxides. In addition to the replacement of a diffusion burner for generating the pilot flame, a further advantage of this configuration is that the presence of the catalytic pilot flame which is low in nitrogen oxides ensures a permanent flow through the catalyst, in which the pilot fuel stream ignites. This prevents the main flame, which occurs during the combustion of the main stream of fuel gas, from backfiring into the catalyst.

The placement of the catalytic supporting burner centrally and the main burner coronally in relation to the cross-section of the flow duct for the fuel is particularly expedient for a homogeneous distribution of the pilot flame in the radial direction, so that the combustion of the main stream of fuel can also take place on a uniform front.

In accordance with another feature of the invention, the pilot fuel stream is guided to the catalytic supporting burner through a preforming stage. This is particularly advantageous for the formation of the pilot flame. A lowering of the catalytic ignition temperature of the pilot fuel stream is thereby achieved, because the fuel is decomposed in the preforming stage into more easily igniting compounds. Where natural gas is concerned, alcohols, such as methanol, aldehydes and hydrogen, for example, are formed in the preforming stage.

In accordance with a further feature of the invention, the pilot fuel stream is intermixed with ambient and/or compressor air. In this way, the low level of nitrogen oxides in the pilot-flame exhaust gas can be further reduced by adjusting the volume ratios of fuel/preformed fuel to ambient and/or compressor air.

In accordance with an added feature of the invention, the fuel outlet of the catalytic supporting burner is disposed between 0.5 and 5 m, and preferably about 0.75 to 2 m, upstream of the gas outlet of the main burner. This is particularly expedient for the stabilization of the main flame in the main burners and for the reliable prevention of the backfiring of the main flame.

In accordance with an additional feature of the invention, the main burner is constructed as a catalytic main burner. Such a burner, like the catalytic supporting burner, is distinguished by comparatively low emissions of nitrogen oxides.

With the objects of the invention in view, there is also provided a gas turbine having the burner described above.

Other features which are considered as characteristic for the invention are set forth in the appended claims.

Although the invention is illustrated and described herein as embodied in a burner, particularly for a gas turbine, with catalytically induced combustion, and a gas turbine having the burner, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 2:
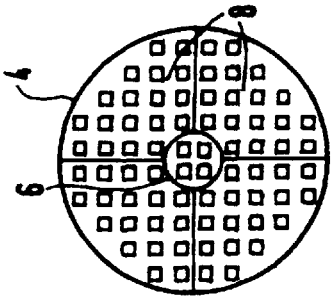
FIGS. 2 and 4 are respective cross-sectional views, as seen from above, through flow ducts in the burner parts according to FIGS. 1 and 3.
Figure 1:
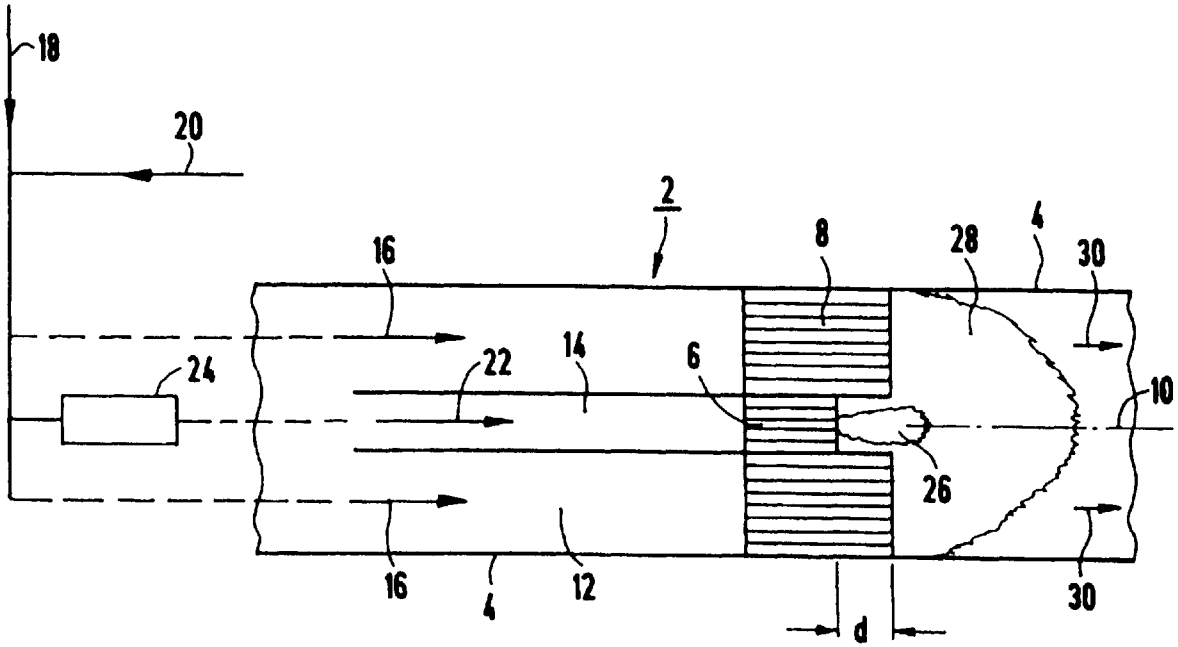
FIGS. 1 and 3 are fragmentary, diagrammatic, longitudinal-sectional views of two different embodiments of a burner part of a gas turbine.
Figure 4:
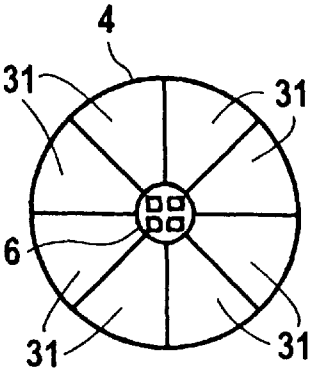
Figure 3:
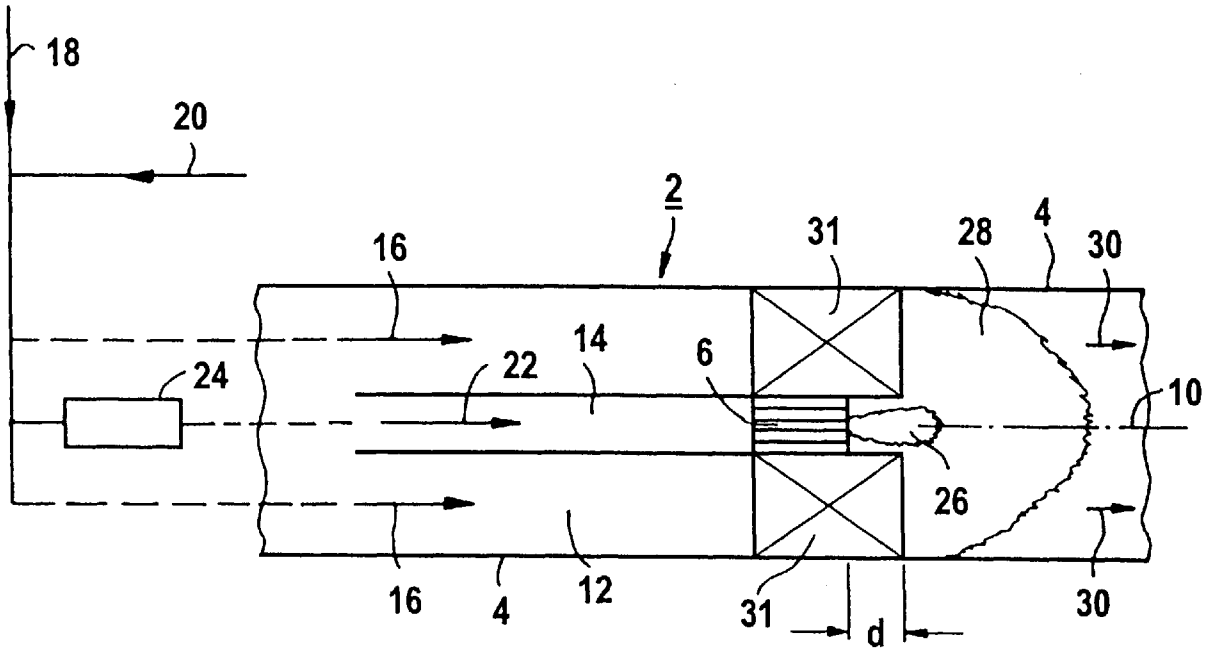

The embodiment according to FIGS. 1 and 2 is identical with the embodiment according to FIGS. 3 and 4, except for one feature. Therefore, the content of the following explanation of FIGS. 1 and 2 is valid for FIGS. 3 and 4 as well.

Referring now in detail to the figures of the drawings, in which identical parts have the same reference symbols, and first, particularly, to FIG. 1 thereof, there is seen a diagrammatic representation of a burner part 2 of a non-illustrated gas turbine. In the exemplary embodiment, the burner part 2 includes a flow duct 4, into which a catalytic supporting burner 6 and a catalytic main burner 8 are incorporated. The catalytic supporting burner 6 and the catalytic main burner 8 are disposed rotationally symmetrically relative to an axis of symmetry 10 of the flow duct 4.

The placement of the catalytic supporting burner 6 centrally in the flow duct 4 gives rise to an outer annular space 12 and an inner central space 14. A fuel mixture 16 which flows in the annular space 12 is compressed through the use of a compressor part of a non-illustrated gas turbine and is formed of fuel gas, in this case natural gas 18, as well as air 20. A pilot fuel stream 22 flowing into the annular space 12 is formed originally of the same natural gas/air mixture 18, 20, although it is preformed in a preforming stage 24. The preformed pilot fuel stream 22 flowing into the supporting burner 6 can also be referred to as an easily igniting pilot fuel stream. The preforming of the natural gas/air mixture 18, 20 takes place on a catalyst which contains precious metal, which has a honeycomb shape, for example, and which includes titanium dioxide as a main constituent and platinum and rhodium as catalytically active components. The catalyst is incorporated in the preforming stage 24 in a non-illustrated manner. Optionally, the catalyst can also be preceded in the preforming stage 24 by a heat exchanger, in order to heat up the natural gas/air mixture 18, 20 entering the preforming stage and to thereby increase the efficiency of the catalyst in the preforming stage 24. During preforming, catalytically comparatively easily igniting materials, such as methanol, aldehyde and hydrogen, are formed from the natural gas 18.

In the exemplary embodiment, a fuel outlet of the catalytic supporting burner 6 is disposed at a distance d of about 1 m upstream of a fuel outlet of the catalytic main burner 8 in the direction of flow of the fuel gas 16. In the exemplary embodiment, the catalytic supporting burner 6 includes a honeycomb catalytic converter which has at least one of the substances, titanium dioxide, silicon dioxide and zirconium oxide as its basic constituent. In principle, all precious metals and metal oxides having a strongly oxidizing effect on the fuels mentioned above are suitable as a catalytically active component. These are, for example, precious metals, such as platinum, rhodium, rhenium, iridium, and metal oxides, such as, for example, the transition-metal oxides, vanadium oxide, tungsten oxide, molybdenum oxide, chromium oxide, copper oxide, manganese oxide and oxides of the lanthanoids, such as, for example, cerium oxide. Metal-ion exchanged zeolites and metal oxides of the spinel type can also be used.

The pilot fuel stream 22 entering the catalytic supporting burner 6 is oxidized through the use of the catalytically active substances and burns with a pilot flame 26. Since the fuel outlet of the supporting burner 6 is disposed at the distance d upstream of the fuel outlet of the main burner 8, as is seen in the direction of flow of the fuel gas 16, this reliably guarantees that the main flame 28 cannot flash back into the catalytic main burner 8 or even into regions upstream of the catalytic burners 6, 8. In the exemplary embodiment selected, the distance d is about 1 m.

The catalyst material in the main burner 8 does not differ from the catalyst material of the supporting burner 6. 1% by weight of platinum and rhodium and 2% by weight of vanadium oxide, chromium oxide and tungsten oxide are provided in each case as a catalytically particularly active substance with regard to the oxidation of the hydrocarbons contained in the fuel 16.

Burner exhaust gas 30 emerging from the burner part 2 has a particularly low nitrogen oxide content, because on one hand, the fuel 16 in the main burner 8 is burnt catalytically, and because on the other hand the pilot flame 26 is likewise generated by catalytic combustion of the pilot fuel stream 22 in the supporting burner 6. Diffusion burners or swirl stabilized premixing burners known from the prior art can also be used as a main burner, as a variation of the catalytic main burner 8.

FIG. 2 shows a top view of the flow duct 4, in which the configuration of the main burner 8 as a catalytically active honeycomb catalytic converter can be seen in a diagrammatic representation. Such honeycomb catalytic converters conventionally have a number of cells equal to 4 to 100 cells per square inch and have webs with a wall thickness of the webs of 0.5 to 5 mm. It is also possible to employ metallic plate catalytic converters or, basically, plate catalytic converters, as an alternative to the honeycomb catalytic converters used in the exemplary embodiment. The catalytic supporting burner 6, which is disposed centrally in the top view according to FIG. 2, is mostly identical in terms of the geometry of its ducts to the geometry of the catalytic main burner 8.

FIGS. 3 and 4 show an embodiment of the invention, in which the catalytic main burner 8 as seen in FIGS. 1 and 2 is replaced by a non-catalytic main burner. The main differentiating feature of the non-catalytic main burner is that it has guide blades 31. These guide blades 31 impress a swirl on the passing fuel-air-mixture, which stabilizes the combustion employed in this mixture. The non-catalytic main burner is characterized by an especially low operational pressure loss and by simplicity of construction, so that this main burner is especially recommended for use in a gas turbine. Due to the fact that the main burner causes a premixing combustion, a comparatively low $No_x$-emission is guaranteed. Since the pilot burner 6 is constructed as a catalytic support burner in the exemplary embodiment according to FIGS. 3 and 4, it does not represent an essential source for nitrogen oxides. Accordingly, the burner according to FIGS. 3 and 4 is qualified as a burner with especially low $No_x$-emission.

We claim:

1. A burner for combusting a fuel, comprising:

a flow conduit extending along a longitudinal axis, said flow conduit conducting a fuel in a given flow direction and having a given cross section taken perpendicular to said longitudinal axis, said cross section having an inner central region at said longitudinal axis and having an outer annular region concentric to said longitudinal axis;

a main burner disposed throughout said outer annular region and having a fuel outlet;

a catalytic support burner disposed in said inner central region and having a fuel outlet in said flow conduit upstream of said fuel outlet of said main burner as seen in said given flow direction, for stabilizing said main burner with catalytic combustion of a pilot fuel stream; and a preforming stage guiding the pilot fuel stream to said catalytic support burner.

2. The burner according to claim 1, wherein the pilot fuel stream is mixed with at least one of ambient and compressor air.

3. The burner according to claim 1, wherein said fuel outlet of said catalytic support burner is disposed between 0.5 and 5 m upstream of said fuel outlet of said main burner.

4. The burner according to claim 1, wherein said fuel outlet of said catalytic support burner is disposed approximately 0.75 to 2 m upstream of said fuel outlet of said main burner.

5. The burner according to claim 1, wherein said main burner is a catalytic main burner.

6. A gas turbine, comprising:

a burner for combusting a fuel, including:

a flow conduit extending along a longitudinal axis, said flow conduit conducting a fuel in a given flow direction and having a given cross section taken perpendicular to said longitudinal axis, said cross section having an inner central region at said longitudinal axis and having an outer annular region concentric to said longitudinal axis;

a main burner disposed throughout said outer annular region and having a fuel outlet;

a catalytic support burner disposed in said inner central region and having a fuel outlet in said flow conduit upstream of said fuel outlet of said main burner as seen in said given flow direction, for stabilizing said main burner with catalytic combustion of a pilot fuel stream; and a preforming stage guiding the pilot fuel stream to said catalytic support burner.

* * * * *